US008208661B2

(12) United States Patent
Jiang et al.

(10) Patent No.: US 8,208,661 B2
(45) Date of Patent: Jun. 26, 2012

(54) HEADPHONE

(75) Inventors: Kai-Li Jiang, Beijing (CN); Lin Xiao, Beijing (CN); Zhuo Chen, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 250 days.

(21) Appl. No.: 12/460,271

(22) Filed: Jul. 16, 2009

(65) Prior Publication Data

US 2010/0086166 A1 Apr. 8, 2010

(30) Foreign Application Priority Data

Oct. 8, 2008 (CN) ..... 2008 1 0216494

(51) Int. Cl.
*H04R 25/00* (2006.01)

(52) U.S. Cl. ..... 381/164; 381/111; 381/380; 381/386

(58) Field of Classification Search ..... 381/164, 381/111, 380, 386
See application file for complete search history.

(56) References Cited

U.S. PATENT DOCUMENTS

| | | | | |
|---|---|---|---|---|
| 1,528,774 | A | 3/1925 | Kranz | |
| 4,002,897 | A | 1/1977 | Kleinman et al. | |
| 4,334,321 | A | 6/1982 | Edelman | |
| 4,503,564 | A * | 3/1985 | Edelman et al. | 398/132 |
| 4,641,377 | A | 2/1987 | Rush et al. | |
| 4,766,607 | A | 8/1988 | Feldman | |
| 5,694,477 | A | 12/1997 | Kole | |
| 6,473,625 | B1 * | 10/2002 | Williams et al. | 455/569.1 |
| 6,777,637 | B2 | 8/2004 | Nakayama et al. | |
| 6,803,116 | B2 | 10/2004 | Ikeda | |
| 6,808,746 | B1 | 10/2004 | Dai et al. | |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,474,590 | B2 | 1/2009 | Watabe et al. | |
| 7,723,684 | B1 | 5/2010 | Haddon et al. | |
| 7,799,163 | B1 | 9/2010 | Mau et al. | |
| 2001/0005272 | A1 | 6/2001 | Buchholz | |
| 2002/0076070 | A1 | 6/2002 | Yoshikawa et al. | |
| 2005/0040371 | A1 | 2/2005 | Watanabe et al. | |
| 2005/0201575 | A1 | 9/2005 | Koshida et al. | |
| 2006/0104451 | A1 | 5/2006 | Browning et al. | |
| 2006/0147081 | A1 * | 7/2006 | Mango et al. | 381/398 |

(Continued)

FOREIGN PATENT DOCUMENTS

| | | | |
|---|---|---|---|
| CN | 2779422 | Y | 5/2006 |

(Continued)

OTHER PUBLICATIONS

Chen, Huxiong; Diebold, Gerald, "Chemical Generation of Acoustic Waves: A Giant Photoacoustic Effect", Nov. 10, 1995, Science, vol. 270, pp. 963-966.

(Continued)

*Primary Examiner* — Davetta W Goins
*Assistant Examiner* — Jasmine Pritchard
(74) *Attorney, Agent, or Firm* — Altis Law Group, Inc.

(57) ABSTRACT

An apparatus includes a headphone. The headphone includes at least one housing; and at least one sound wave generator disposed in the housing. The sound wave generator includes at least one carbon nanotube structure.

19 Claims, 16 Drawing Sheets

U.S. PATENT DOCUMENTS

| | | | | |
|---|---|---|---|---|
| 2006/0264717 | A1 | 11/2006 | Pesach et al. | |
| 2007/0166223 | A1 | 7/2007 | Jiang et al. | |
| 2008/0095694 | A1 | 4/2008 | Nakayama et al. | |
| 2008/0170982 | A1 * | 7/2008 | Zhang et al. | 423/447.3 |
| 2009/0016951 | A1 | 1/2009 | Kawabata et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167137 | A1 | 7/2009 | Liu et al. | |
| 2010/0054502 | A1 | 3/2010 | Miyachi | |
| 2010/0054507 | A1 | 3/2010 | Oh et al. | |
| 2011/0171419 | A1 | 7/2011 | Li et al. | |
| 2012/0000293 | A1 * | 1/2012 | Baughman et al. | 73/861.08 |

FOREIGN PATENT DOCUMENTS

| | | |
|---|---|---|
| CN | 2787870 | 6/2006 |
| CN | 1821048 | 8/2006 |
| CN | 1886820 | 12/2006 |
| CN | 201150134 | 11/2008 |
| CN | 101471213 | 7/2009 |
| CN | 101400198 | 9/2010 |
| JP | 49-24593 | 3/1974 |
| JP | 60-22900 | 2/1985 |
| JP | 1-255398 | 10/1989 |
| JP | 3-147497 | 6/1991 |
| JP | 4-126489 | 4/1992 |
| JP | 11-300274 | 11/1999 |
| JP | 2002-186097 | 6/2002 |
| JP | 2003198281 | 7/2003 |
| JP | 2003-266399 | 9/2003 |
| JP | 2003-319490 | 11/2003 |
| JP | 2004229250 | 8/2004 |
| JP | 2005-51284 | 2/2005 |
| JP | 2005-73197 | 3/2005 |
| JP | 2005189322 | 7/2005 |
| JP | 2005-341554 | 12/2005 |
| JP | 2005333601 | 12/2005 |
| JP | 2007-187976 | 7/2007 |
| JP | 2008-101910 | 5/2008 |
| JP | 2009-91239 | 4/2009 |
| JP | 2009-94074 | 4/2009 |
| JP | 2009-146896 | 7/2009 |
| JP | 2009-146898 | 7/2009 |
| KR | 10-0761548 | 9/2007 |
| TW | 200740976 | 11/2007 |
| TW | 200744399 | 12/2007 |
| WO | WO0073204 | 12/2000 |
| WO | WO2007099975 | 9/2007 |
| WO | WO2008/029451 | 3/2008 |

OTHER PUBLICATIONS

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

Strutt John William, Rayleigh Baron, The Theory of Sound, 1926, pp. 226-235, vol. 2.

W. Yi, L.Lu, Zhang Dianlin et al., Linear Specific Heat of Carbon Nanotubes, Physical Review B, Apr. 1, 1999, vol. 59, No. 14, R9015-9018.

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

Braun Ferdinand, Notiz uber Thermophonie, Ann. Der Physik, Apr. 1898, pp. 358-360,vol. 65.

Zhuangchun Wu, Zhihong Chen, Xu Du et al.,Transparent, Conductive Carbon Nanotube Films, Science, Aug. 27, 2004, pp. 1273-1276, vol. 305.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

J.J.Hopfield, Spectra of Hydrogen, Nitrogen and Oxygen in the Extreme Ultraviolet, Physical Review, 1922, pp. 573-588,vol. 20.

Kaili Jiang, Qunqing Li, Shoushan Fan, Spinning continuous carbon nanotube yarns, Nature, Oct. 24, 2002, pp. 801, vol. 419.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Swift Gregory W., Thermoacoustic Engines and Refrigerators, Physics Today, Jul. 1995, pp. 22-28, vol. 48.

William Henry Preece, On Some Thermal Effects of Electric Currents, Proceedings of the Royal Society of London, 1879-1880, pp. 408-411, vol. 30.

H.D. Arnold, I.B. Crandall, The Thermophone as a Precision Source of Sound, Physical Review, 1917, pp. 22-38, vol. 10.

Frank P. Incropera, David P. Dewitt et al., Fundamentals of Heat and Mass Transfer, 6th ed., 2007, pp. A-5, Wiley:Asia.

P. De Lange, On Thermophones, Proceedings of the Royal Society of London. Series A, Apr. 1, 1915, pp. 239-241, vol. 91, No. 628.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Edward C. Wente, The Thermophone, Physical Review, 1922, pp. 333-345,vol. 19.

http://www.physorg.com/news123167268.html.

Amos, S.W.; "Principles of Transistor Circuits"; 2000; Newnes-Butterworth-Heinemann; 9th ed.;p. 114.

Lee et al., Photosensitization of nonlinear scattering and photoacoustic emission from single-walled carbon nanotubes, Applied Physics Letters, Mar. 13, 2008, 92, 103122.

Silvanus P. Thompson, The Photophone, Nature, Sep. 23, 1880, vol. XXII, No. 569, pp. 481.

Alexander Graham Bell, Selenium and the Photophone, Nature, Sep. 23, 1880, pp. 500-503.

* cited by examiner

HEADPHONE

RELATED APPLICATIONS

This application is related to a co-pending application entitled, "LOUDSPEAKER", 12/460,270, filed Jul. 16, 2009.

BACKGROUND

1. Technical Field

The present disclosure relates to headphones and, particularly, to a carbon nanotube based headphone.

2. Description of Related Art

Conventional headphone generally includes a headphone housing and an sound wave generator disposed in the headphone housing. The headphones can be categorized by shape into ear-cup (or on-ear) type headphones, earphones, ear-hanging headphones, and so on. The earphones can be disposed in one's ears. The ear-cup type headphones and ear-hanging headphones are disposed outside and attached to one's ears. The ear-cup type headphones have circular or ellipsoid ear-pads that completely surround the ears. The ear-hanging type headphones have ear-pads that sit on top of the ears, rather than around them. The headphones can also be categorized as wired headphones and wireless headphones.

The headphone housing generally is a plastic or resin shell structure defining a hollow space therein. The sound wave generator inside the headphone housing is used to transform an electrical signal into sound pressure that can be heard by human ears. There are different types of sound wave generators that can be categorized according by their working principle, such as electro-dynamic sound wave generators, electromagnetic sound wave generators, electrostatic sound wave generators and piezoelectric sound wave generators. However, all the various types ultimately use mechanical vibration to produce sound waves and rely on "electro-mechanical-acoustic" conversion. Among the various types, the electro-dynamic sound wave generators are most widely used.

Referring to FIG. 16, a related earphone 10, according to the prior art, with an electro-dynamic sound wave generator 100 is shown. The earphone 10 typically includes a housing 110. The sound wave generator 100 is disposed in the housing 110. The sound wave generator 100 includes a voice coil 102, a magnet 104 and a cone 106. The voice coil 102 is an electrical conductor, and is placed in the magnetic field of the magnet 104. By applying an electrical current to the voice coil 102, a mechanical vibration of the cone 106 is produced due to the interaction between the electromagnetic field produced by the voice coil 102 and the magnetic field of the magnets 104, thus producing sound waves. However, the structure of the electric-powered sound wave generator 100 is dependent on magnetic fields and often weighty magnets.

Carbon nanotubes (CNT) are a novel carbonaceous material and have received a great deal of interest since the early 1990s. Carbon nanotubes have interesting and potentially useful electrical and mechanical properties, and have been widely used in a plurality of fields.

What is needed, therefore, is to provide a headphone having a simple lightweight structure.

BRIEF DESCRIPTION OF THE DRAWINGS

Many aspects of the present headphone can be better understood with reference to the following drawings. The components in the drawings are not necessarily to scale, the emphasis instead being placed upon clearly illustrating the principles of the present headphone.

Figure 1:
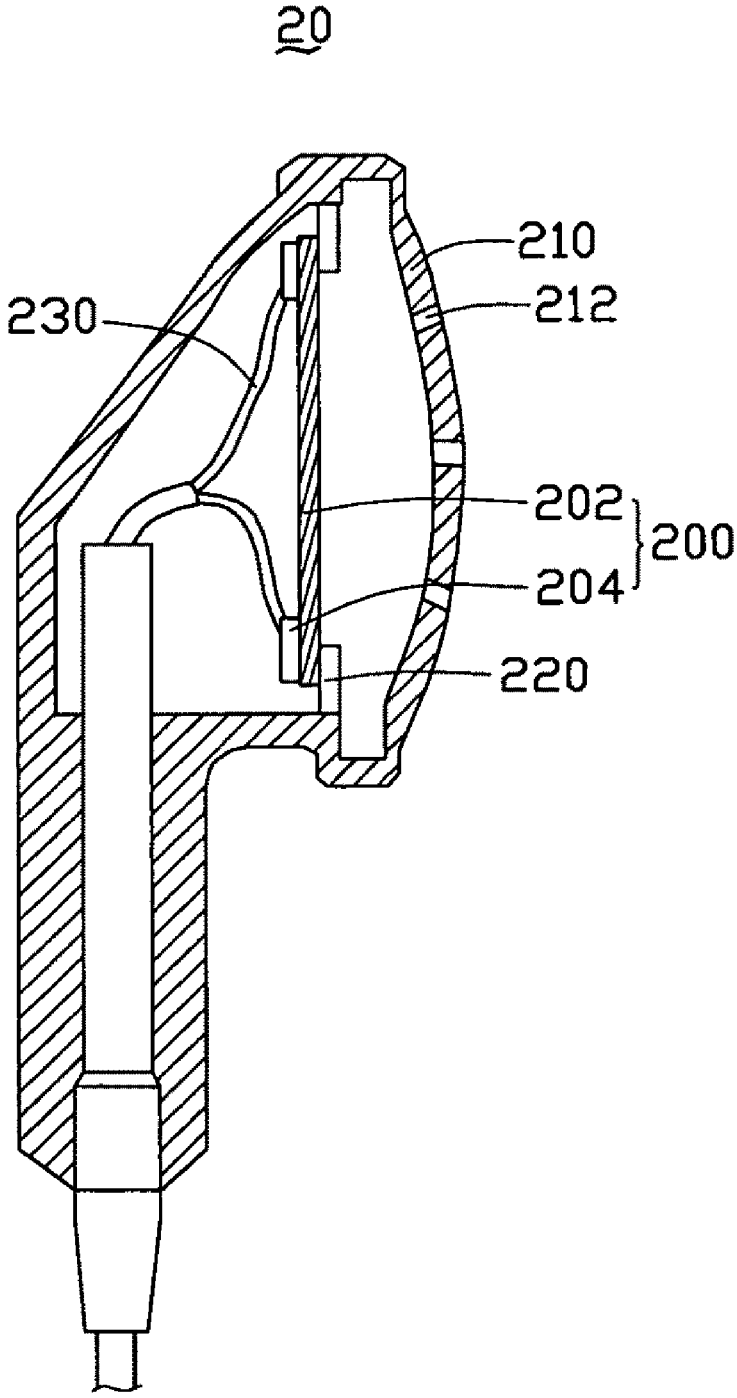
FIG. 1 is a schematic structural view of a headphone.

Corresponding reference characters indicate corresponding parts throughout the several views. The exemplifications set out herein illustrate at least one exemplary embodiment of the present headphone, in at least one form, and such exemplifications are not to be construed as limiting the scope of the invention in any manner.

DETAILED DESCRIPTION OF EXEMPLARY EMBODIMENTS

Reference will now be made to the drawings to describe, in detail, embodiments of the present headphone.

Referring to FIG. 1, an earphone 20 according to an embodiment includes a housing 210 and an sound wave generator 200 disposed in the housing 210. The housing 210 has a hollow structure and can be made of lightweight but strong plastic or resin. The sound wave generator 200 is disposed in the hollow structure. The headphone 20 can further include a wire 230 capable of transmitting electrical signals. The wire 230 is connected to the sound wave generator 200.

The housing 210 defines at least a through hole 212 (e.g., an opening). The housing 210 can be in the size to be accommodated in one's ear. In one embodiment, the through hole 212 is directed towards the ear.

Figure 2:
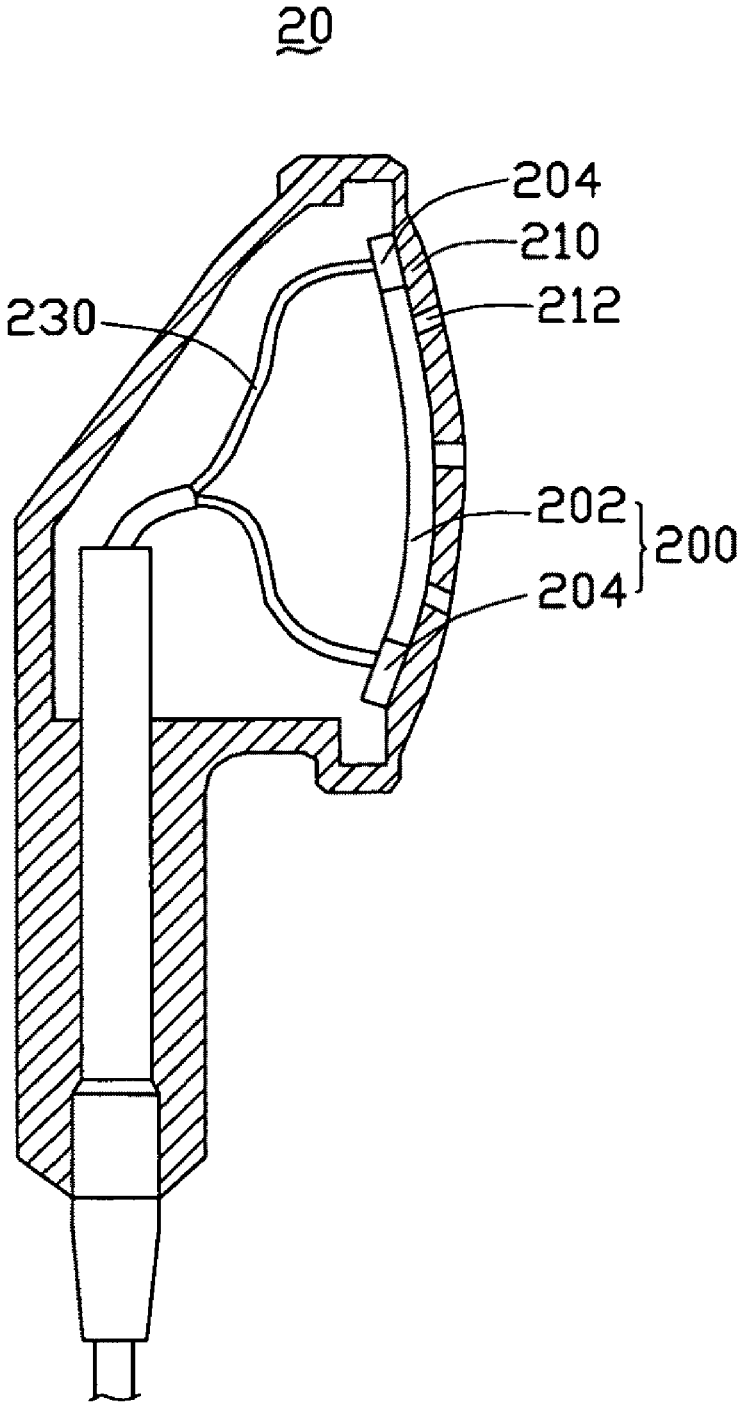
FIG. 2 is a schematic structural view of a headphone of FIG. 1 wherein the sound wave generator covers through holes.

In one embodiment, the sound wave generator 200 is spaced from and aligned with the through hole 212. The inside of the housing 210 communicates acoustically with the outside through the through hole 212. The sound emitted by the sound wave generator 200 is transmitted through the through hole 212 to the outside of the earphone 20. Referring to FIG. 2, in another embodiment, the sound wave generator 200 can cover the through hole 212.

The sound wave generator 200 includes a carbon nanotube structure 202. The carbon nanotube structure 202 can have many different forms and a large specific surface area (e.g., above 50 $m^2/g$). The heat capacity per unit area of the carbon nanotube structure 202 can be less than $2\times10^{-4}$ $J/cm^2\cdot K$. In one embodiment, the heat capacity per unit area of the carbon nanotube structure 202 is less than or equal to about $1.7\times10^{-6}$ $J/cm^2\cdot K$. In one embodiment, the sound wave generator 200 is a carbon nanotube structure 202 with a large specific surface area contacting to the surrounding medium and a small heat capacity per unit area, and the carbon nanotube structure 202 are composed of the carbon nanotubes.

The carbon nanotube structure 202 can include a plurality of carbon nanotubes uniformly distributed therein, and the carbon nanotubes therein can be combined by van der Waals attractive force therebetween. It is understood that the carbon nanotube structure 202 includes metallic carbon nanotubes. The carbon nanotubes in the carbon nanotube structure 202 can be arranged orderly or disorderly. The term 'disordered carbon nanotube film' includes, but is not limited to, a structure where the carbon nanotubes are arranged along many different directions, arranged such that the number of carbon nanotubes arranged along each different direction can be almost the same (e.g. uniformly disordered); and/or entangled with each other. The disordered carbon nanotube film comprises of randomly aligned carbon nanotubes. When the disordered carbon nanotube structure comprises of a structure wherein the number of the carbon nanotubes aligned in every direction is substantially equal, the disordered carbon nanotube structure can be isotropic. The disordered carbon nanotubes film can be substantially parallel to a surface of the disordered carbon nanotube structure. 'Ordered carbon nanotube film' includes, but is not limited to, a structure where the carbon nanotubes are arranged in a substantially systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure 202 can be selected from a group consisting of single-walled, double-walled, and/or multi-walled carbon nanotubes. It is also understood that there may be many layers of ordered and/or disordered carbon nanotube films in the carbon nanotube structure 202.

The carbon nanotube structure 202 may have a substantially planar structure. The thickness of the carbon nanotube structure 202 may range from about 0.5 nanometers to about 1 millimeter. The larger the specific surface area of the carbon nanotube structure 202, the smaller the heat capacity will be per unit area. The smaller the heat capacity per unit area, the higher the sound pressure level of the acoustic device.

Figure 3:
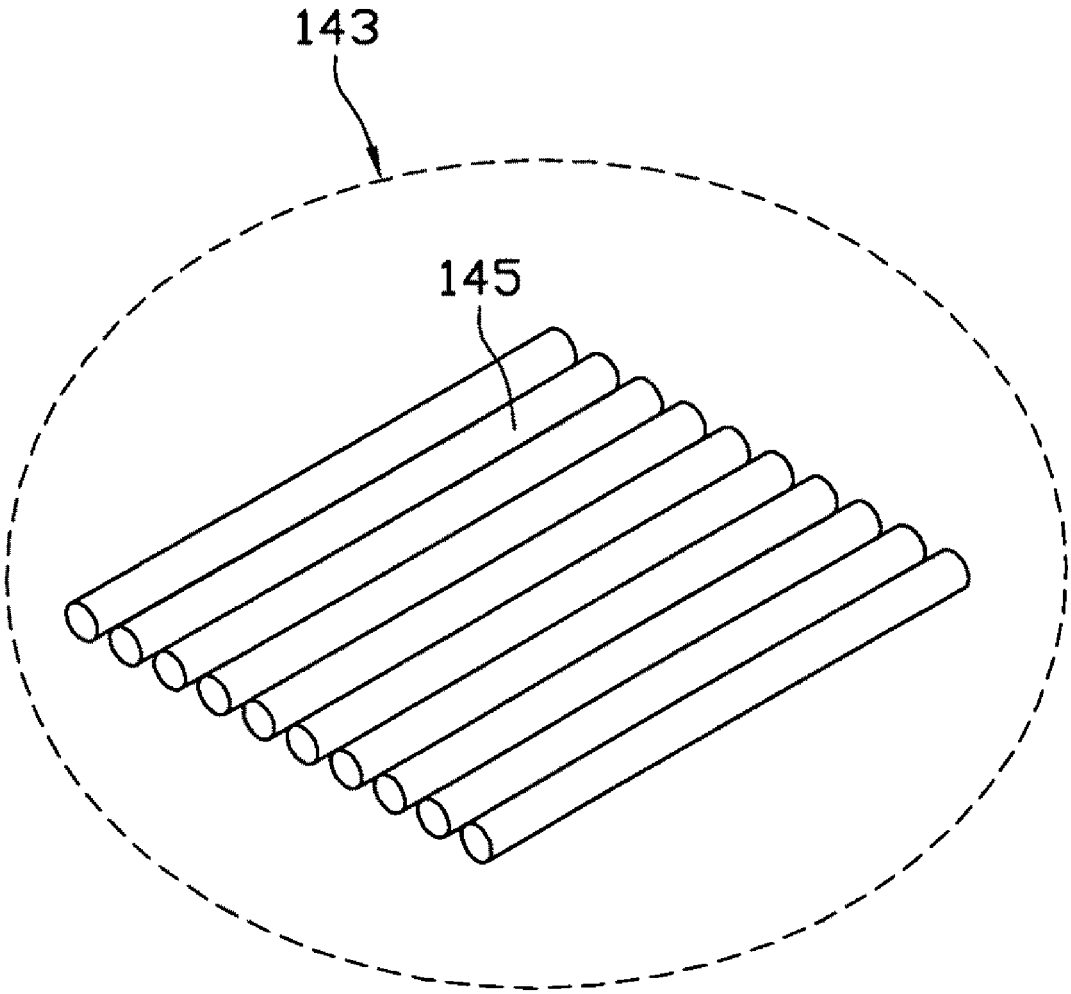
FIG. 3 is a schematic structural view of a carbon nanotube segment in a drawn carbon nanotube film.
Figure 4:
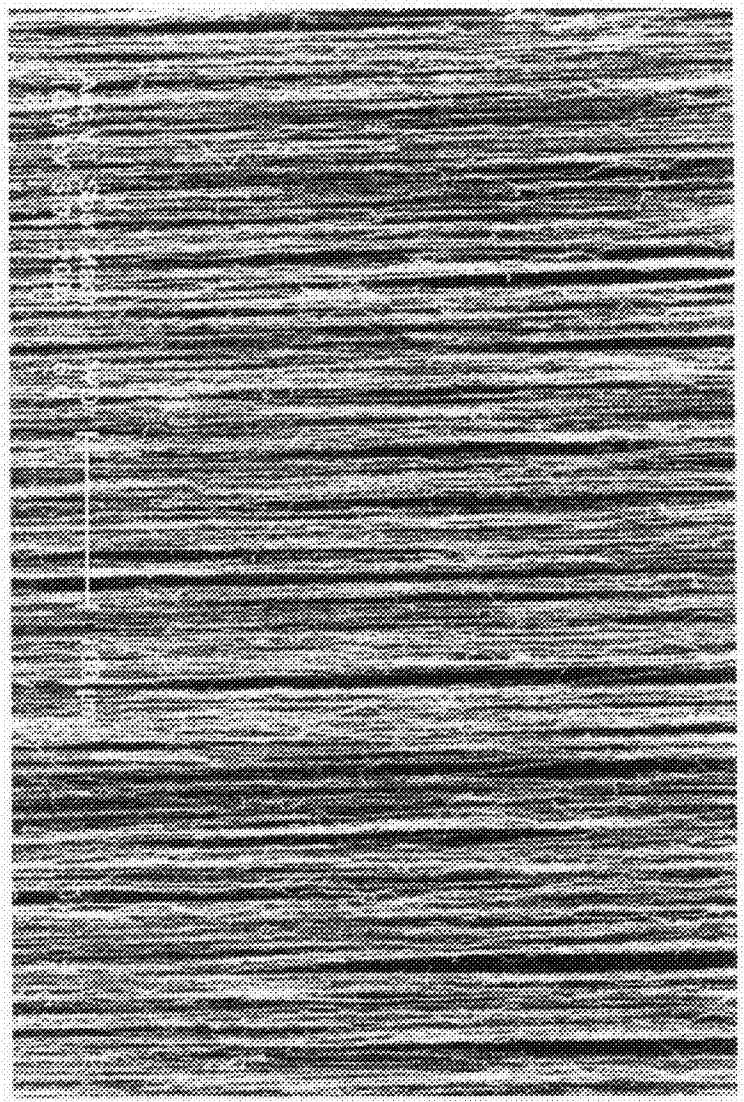
FIG. 4 shows a Scanning Electron Microscope (SEM) image of the drawn carbon nanotube film.

In one embodiment, the carbon nanotube structure 202 can include at least one drawn carbon nanotube film. Examples of a drawn carbon nanotube film is taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array that is capable of having a film drawn therefrom. Referring to FIGS. 3 to 4, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 4, some variations can occur in the drawn carbon nanotube film. The carbon nanotubes 145 in the drawn carbon nanotube film are also oriented along a preferred orientation. The plurality of carbon nanotubes 145 joined end-to-end to form the free-standing drawn carbon nanotube film. Free standing includes films that do not have to be, but still can be supported. The carbon nanotube film also can be treated with an organic solvent. After treatment, the mechanical strength and toughness of the treated carbon nanotube film are increased and the coefficient of friction of the treated carbon nanotube films is reduced. The treated carbon nanotube film has a larger heat capacity per unit area and thus produces less of a thermoacoustic effect than the same untreated film. A thickness of the carbon nanotube film can range from about 0.5 nanometers to about 100 micrometers. The single drawn carbon nanotube film has a specific surface area of above about 100 $m^2/g$.

The carbon nanotube structure 202 of the sound wave generator 200 can include at least two stacked carbon nanotube films. In other embodiments, the carbon nanotube structure 202 can include two or more coplanar carbon nanotube films or both coplanar and stacked films. Additionally, an angle can exist between the orientations of carbon nanotubes in stacked and/or adjacent ordered films. Stacked or adjacent carbon nanotube films can be combined only by the van der Waals attractive force therebetween. The number of the layers of the carbon nanotube films is not limited. However, as the stacked number of the carbon nanotube films increasing, the specific surface area of the carbon nanotube structure will decrease, and a large enough specific surface area (e.g., above 30 $m^2/g$) must be maintained to achieve the thermoacoustic effect, and produce sound effectively. An angle between the aligned directions of the carbon nanotubes in the two adjacent carbon nanotube films can range from above 0° to about 90°. When the angle between the aligned directions of the carbon nanotubes in adjacent carbon nanotube films is larger than 0 degrees, a microporous structure is defined by the carbon nanotubes in the carbon nanotube structure 202. The carbon nanotube structure 202 in an embodiment employing these films will have a plurality of micropores. Stacking the carbon nanotube films will add to the structural integrity of the carbon nanotube structure 202. In some embodiments, the carbon nanotube structure 202 has a free standing structure and does not require the use of structural support.

Figure 5:
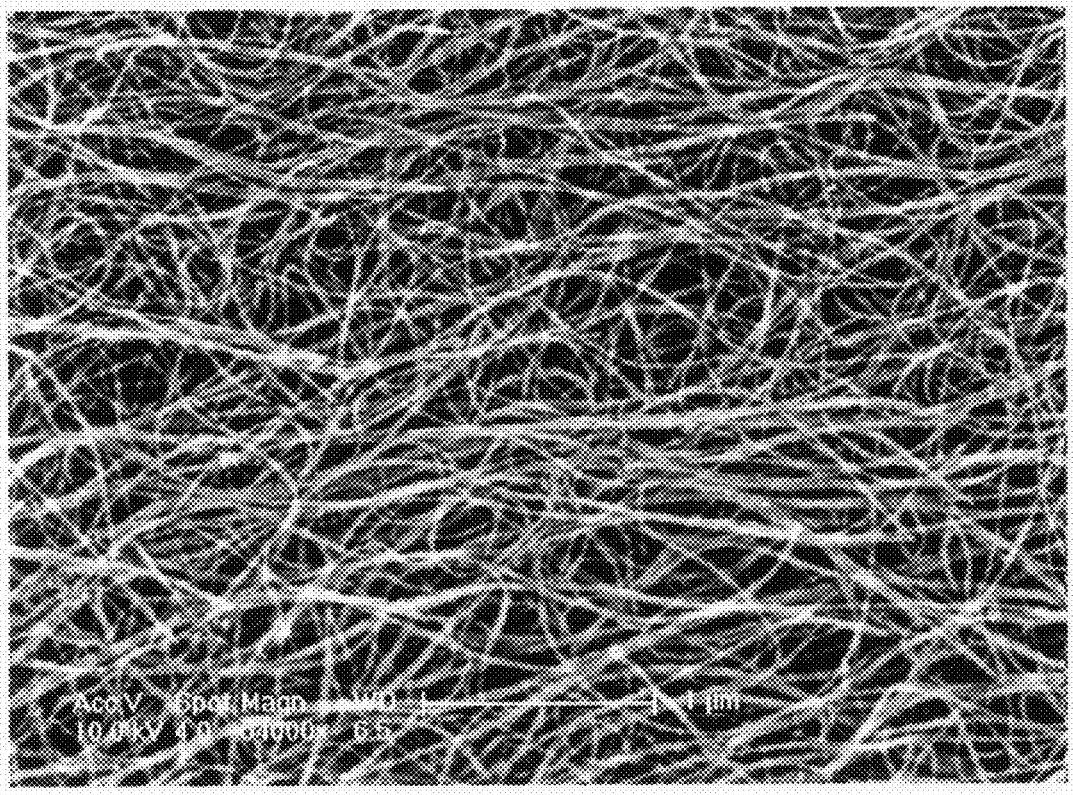
FIG. 5 shows an SEM image of another carbon nanotube film with carbon nanotubes entangled with each other.

In other embodiments, the carbon nanotube structure 202 includes a flocculated carbon nanotube film. Referring to FIG. 5, the flocculated carbon nanotube film can include a plurality of long, curved, disordered carbon nanotubes entangled with each other. A length of the carbon nanotubes can be above 10 centimeters. Further, the flocculated carbon nanotube film can be isotropic. The carbon nanotubes can be substantially uniformly dispersed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure 202. Further, due to the carbon nanotubes in the carbon nanotube structure 202 being entangled with each other, the carbon nanotube structure 202 employing the flocculated carbon nanotube film has excellent durability, and can be fashioned into desired shapes with a low risk to the integrity of carbon nanotube structure 202. Thus, the sound wave generator 200 may be formed into many shapes. The flocculated carbon nanotube film, in some embodiments, will not require the use of structural support due to the carbon nanotubes being entangled and adhered together by van der Waals attractive force therebetween. The thickness of the flocculated carbon nanotube film can range from about 0.5 nanometers to about 1 millimeter.

Figure 6:
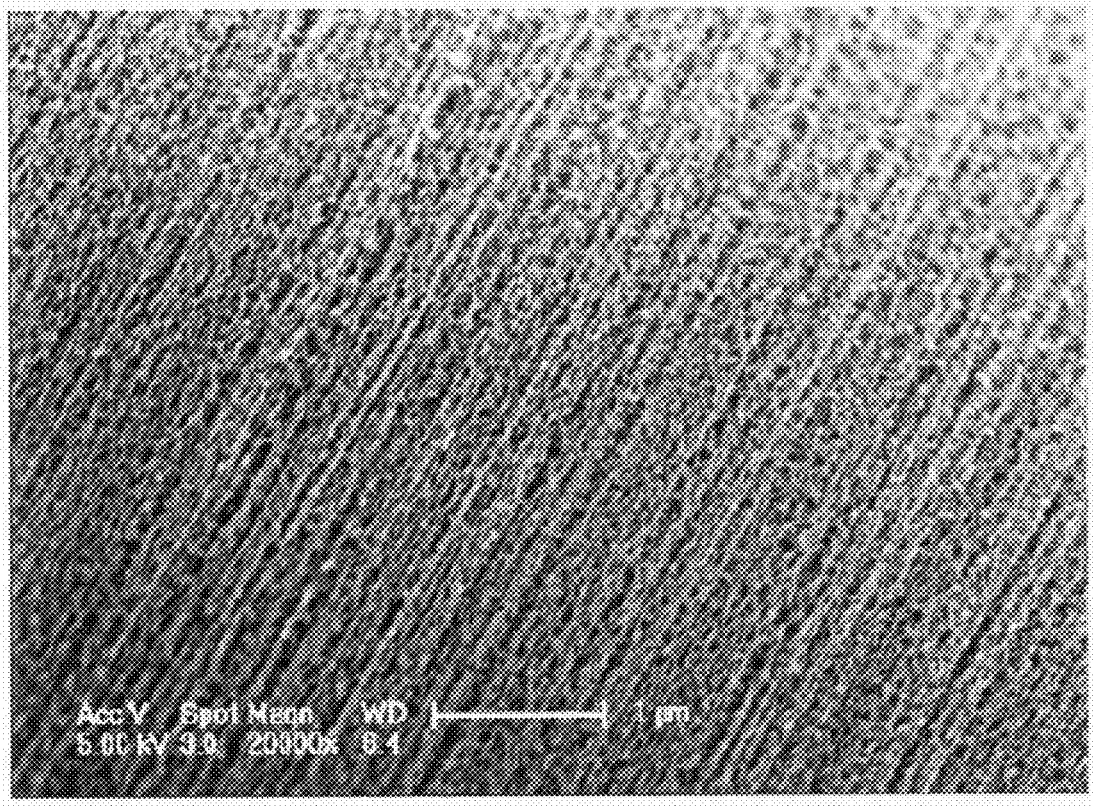
FIG. 6 shows an SEM image of a carbon nanotube film segment.

In other embodiments, the carbon nanotube structure 202 includes a carbon nanotube segment film that comprises of at least one carbon nanotube segment. Referring to FIG. 6, a carbon nanotube segment includes a plurality of carbon nanotubes arranged along a common direction. In one embodiment, the carbon nanotube segment film can comprise one carbon nanotube segment. The carbon nanotube segment includes a plurality of carbon nanotubes arranged along a same direction. The carbon nanotubes in the carbon nanotube segment are substantially parallel to each other, have an almost equal length and are combined side by side via van der Waals attractive force therebetween. At least one carbon nanotube will span the entire length of the carbon nanotube segment, so that one of the dimensions of the carbon nanotube segment film corresponds to the length of the segment. Thus, the length of the carbon nanotube segment is only limited by the length of the carbon nanotubes.

In some embodiments, the carbon nanotube segment film can be produced by growing a strip-shaped carbon nanotube array, and pushing the strip-shaped carbon nanotube array down along a direction perpendicular to length of the strip-shaped carbon nanotube array, and has a length ranged from about 1 millimeter to about 10 millimeters. The length of the carbon nanotube segment is only limited by the length of the strip. A carbon nanotube segment film also can be formed by having a plurality of these strips lined up side by side and folding the carbon nanotubes grown thereon over, such that there is overlap between the carbon nanotubes on adjacent strips.

In some embodiments, the carbon nanotube film can be produced by a method adopting a "kite-mechanism" and can have carbon nanotubes with a length of even above 10 centimeters. This is considered by some to be ultra-long carbon nanotubes. However, this method can be used to grow carbon nanotubes of many sizes. Specifically, the carbon nanotube film can be produced by providing a growing substrate with a catalyst layer located thereon; placing the growing substrate adjacent to the insulating substrate in a chamber; and heating the chamber to a growth temperature for carbon nanotubes under a protective gas, and introducing a carbon source gas along a gas flow direction, growing a plurality of carbon nanotubes on the insulating substrate. After introducing the carbon source gas into the chamber, the carbon nanotubes starts to grow under the effect of the catalyst. One end (e.g., the root) of the carbon nanotubes is fixed on the growing substrate, and the other end (e.g., the top/free end) of the carbon nanotubes grow continuously. The growing substrate is near an inlet of the introduced carbon source gas, the ultra-long carbon nanotubes float above the insulating substrate with the roots of the ultra-long carbon nanotubes still sticking on the growing substrate, as the carbon source gas is continuously introduced into the chamber. The length of the ultra-long carbon nanotubes depends on the growth conditions. After growth has been stopped, the ultra-long carbon nanotubes land on the insulating substrate. The carbon nanotubes are then separated from the growing substrate. This can be repeated many times so as to obtain many layers of carbon nanotube films on a single insulating substrate. The layers may have an angle from 0 degree to less than or equal to 90 degrees between them by changing the orientation of the insulating substrate between growing cycles.

The carbon nanotube structure 202 can further include at least two stacked or coplanar carbon nanotube segments. Adjacent carbon nanotube segments can be adhered together by van der Waals attractive force therebetween. An angle between the aligned directions of the carbon nanotubes in adjacent two carbon nanotube segments ranges from 0 degree to about 90 degrees. A thickness of a single carbon nanotube film segment can range from about 0.5 nanometers to about 100 micrometers.

Further, the carbon nanotube film and/or the entire carbon nanotube structure 202 can be treated, such as by laser, to improve the light transmittance and the heat capacity per unit area of the carbon nanotube film or the carbon nanotube structure 202. For example, the light transmittance of the untreated drawn carbon nanotube film ranges from about 70%-80%, and after laser treatment, the light transmittance of the untreated drawn carbon nanotube film can be improved to about 95%. The heat capacity per unit area of the carbon nanotube film and/or the carbon nanotube structure 202 will increase after the laser treatment.

In other embodiments, the carbon nanotube structure 202 includes one or more carbon nanotube wire structures. The carbon nanotube wire structure includes at least one carbon nanotube wire. A heat capacity per unit area of the carbon nanotube wire structure can be less than $2\times10^{-4}$ J/cm$^2$·K. In one embodiment, the heat capacity per unit area of the carbon nanotube wire structure is less than $5\times10^{-5}$ J/cm$^2$·K. The carbon nanotube wire can be twisted or untwisted. The carbon nanotube wire structure can also includes twisted or untwisted carbon nanotube cables. These carbon nanotube cables can include twisted carbon nanotube wires, untwisted carbon nanotube wires, or combination thereof. The carbon nanotube wires in the carbon nanotube cables structure can be parallel to each other to form a bundle-like structure or twisted with each other to form a twisted structure.

Figure 7:
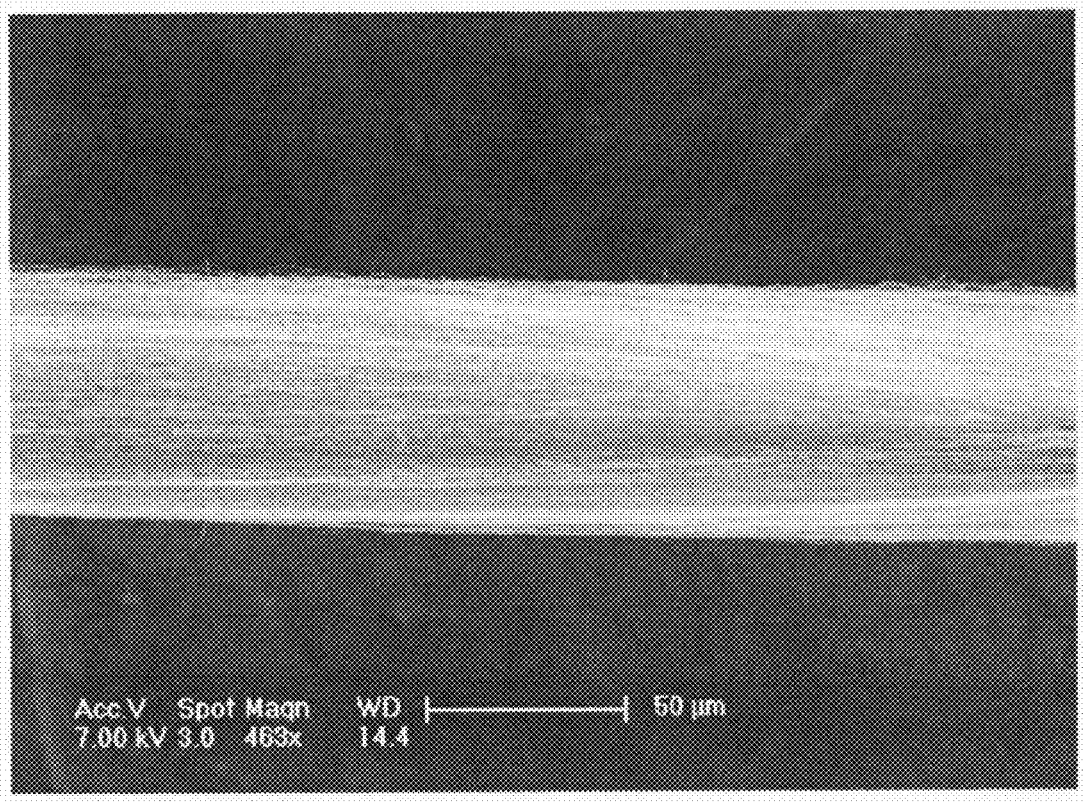
FIG. 7 shows an SEM image of an untwisted carbon nanotube wire.

The untwisted carbon nanotube wire can be formed by treating the drawn carbon nanotube film with an organic solvent. In one method, the drawn carbon nanotube film is treated by applying the organic solvent to the drawn carbon nanotube film to the entire surface of the drawn carbon nanotube film. After being soaked by the organic solvent, the adjacent paralleled carbon nanotubes in the drawn carbon nanotube film will bundle together, due to the surface tension of the organic solvent when the organic solvent volatilizing, and thus, the drawn carbon nanotube film will be shrunk into untwisted carbon nanotube wire. Referring to FIG. 7, the untwisted carbon nanotube wire includes a plurality of carbon nanotubes substantially oriented along a same direction (e.g., a direction along the length of the untwisted carbon nanotube wire). The carbon nanotubes are substantially parallel to the axis of the untwisted carbon nanotube wire. Length of the untwisted carbon nanotube wire can be set as desired. The diameter of an untwisted carbon nanotube wire can range from about 0.5 nanometers to about 100 micrometers. In one embodiment, the diameter of the untwisted carbon nanotube wire is about 50 micrometers. Examples of the untwisted carbon nanotube wire are taught by US Patent Application Publication US 2007/0166223 to Jiang et al.

Figure 8:
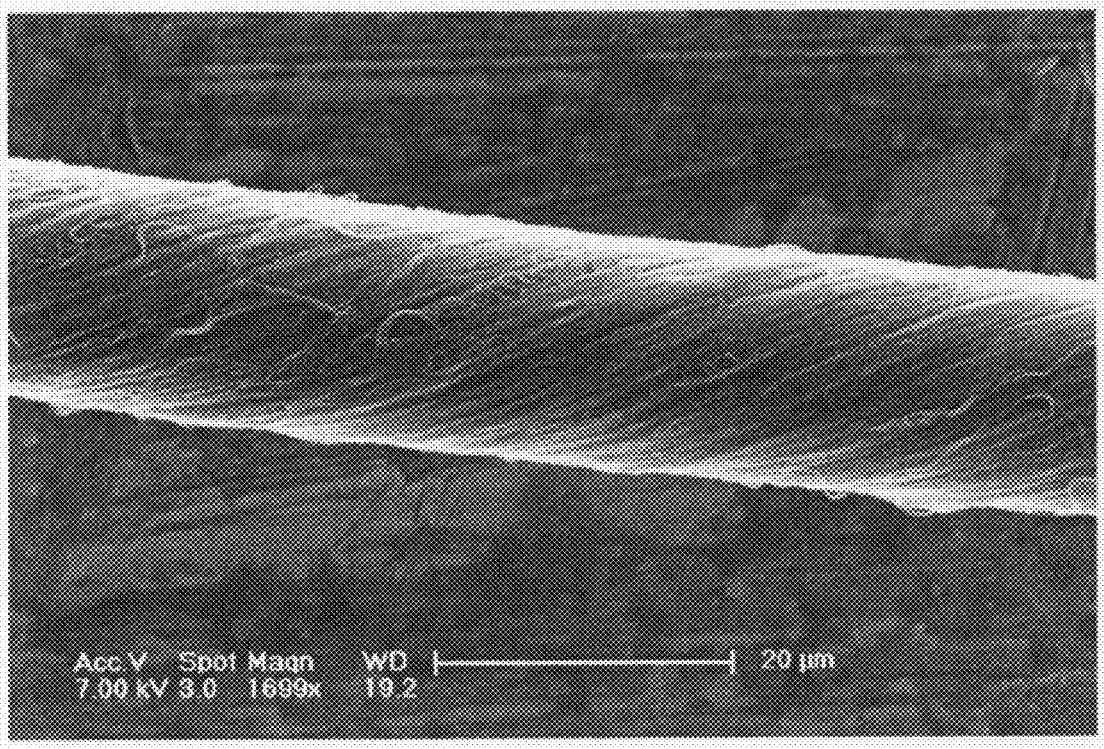
FIG. 8 shows an SEM image of a twisted carbon nanotube wire.

The twisted carbon nanotube wire can be formed by twisting a drawn carbon nanotube film by using a mechanical force to turn the two ends of the drawn carbon nanotube film in opposite directions. Referring to FIG. 8, the twisted carbon nanotube wire includes a plurality of carbon nanotubes oriented around an axial direction of the twisted carbon nanotube wire. Length of the carbon nanotube wire can be set as desired. The diameter of the twisted carbon nanotube wire can range from about 0.5 nanometers to about 100 micrometers. Further, the twisted carbon nanotube wire can be treated with a volatile organic solvent. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease. The density and strength of the twisted carbon nanotube wire will be increased.

Figure 9:
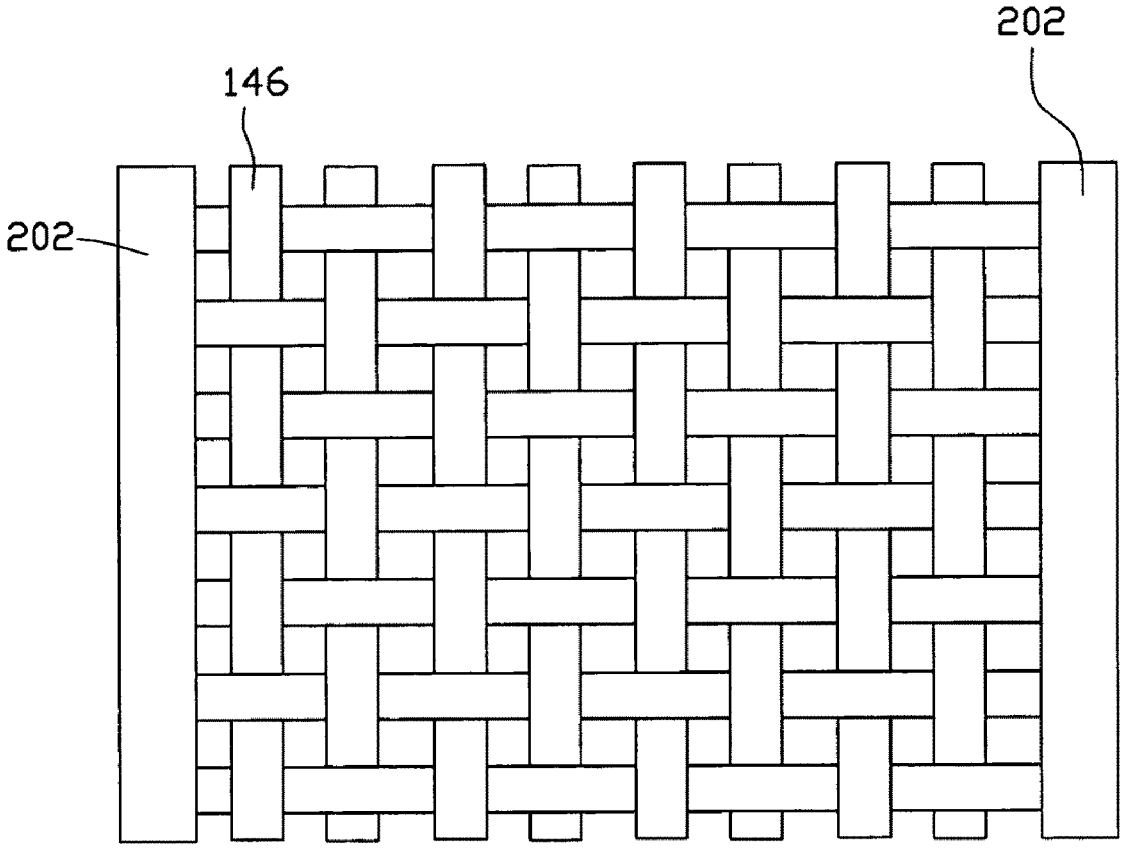
FIG. 9 shows a textile formed by a plurality of carbon nanotube wire structures or films.

The carbon nanotube structure 202 can include a plurality of carbon nanotube wire structures. The plurality of carbon nanotube wire structures can be parallel with each other, cross with each other, weaved together, or twisted with each other to form a planar structure. Referring to FIG. 9, a textile can be formed by the carbon nanotube wire structures 146 and used as the carbon nanotube structure 202. The two electrodes 220 can be located at two opposite ends of the textile and electrically connected to the carbon nanotube wire structures 146. It is also understood that carbon nanotube films can be cross with each other, weaved together, twisted with each other to form a planar structure, or form a textile as shown in FIG. 9.

In the embodiment shown in FIG. 1, the sound wave generator 200 includes a carbon nanotube structure 202 comprising the drawn carbon nanotube film, and the drawn carbon nanotube film includes a plurality of carbon nanotubes arranged along a preferred direction. The length of the carbon nanotube structure 202 is about 5 millimeters, the width thereof is about 3 millimeters, and the thickness thereof is about 50 nanometers. It can be understood that when the thickness of the carbon nanotube structure 202 is small, for example, less than 10 micrometers, the sound wave generator 200 has greater transparency. Thus, it is possible to acquire a transparent earphone 20 by employing a transparent carbon nanotube structure 202 comprising of a transparent carbon nanotube film in a transparent housing 210.

It is to be understood that the earphone 20 can include several sound wave generators 200 disposed in the housing 210. At least one sound wave generator 200 includes the carbon nanotube structure 202, and the other sound wave generators can be other type sound wave generators such as another carbon nanotube structure 202, electro-dynamic sound wave generators, electromagnetic sound wave generators, electrostatic sound wave generators, and piezoelectric sound wave generators.

The sound wave generator 200 can further include at least two electrodes 204 spaced from each other and electrically connected to the carbon nanotube structure 202. The electrodes 204 can be disposed and fixed on two ends of the carbon nanotube structure 202. The electrodes 204 are used to receive the electrical signals from the wire 230 and transmit them to the carbon nanotube structure 202.

When the carbon nanotubes in the carbon nanotube structure 202 are aligned along a same direction (such as the carbon nanotubes in the drawn carbon nanotube film or carbon nanotube segment film), the electrodes 204 can be disposed at two opposite ends of the carbon nanotube aligned direction. Thus, the carbon nanotubes in the carbon nanotube structure 202 are aligned along the direction from one electrode 204 to the other electrode 204. The electrode 204 can be strip shaped and parallel to each other. The electrical signals are conducted to the carbon nanotube structure 202. The carbon nanotubes in the carbon nanotube structure 202 transform the electrical energy to thermal energy. The thermal energy heats the medium, changes the density of the air, and thereby emits sound waves. No movement is required by the sound wave generator to create sound waves. Even if the sound wave generator is moving, it has minimal effect on the sound waves produced.

Figure 10:
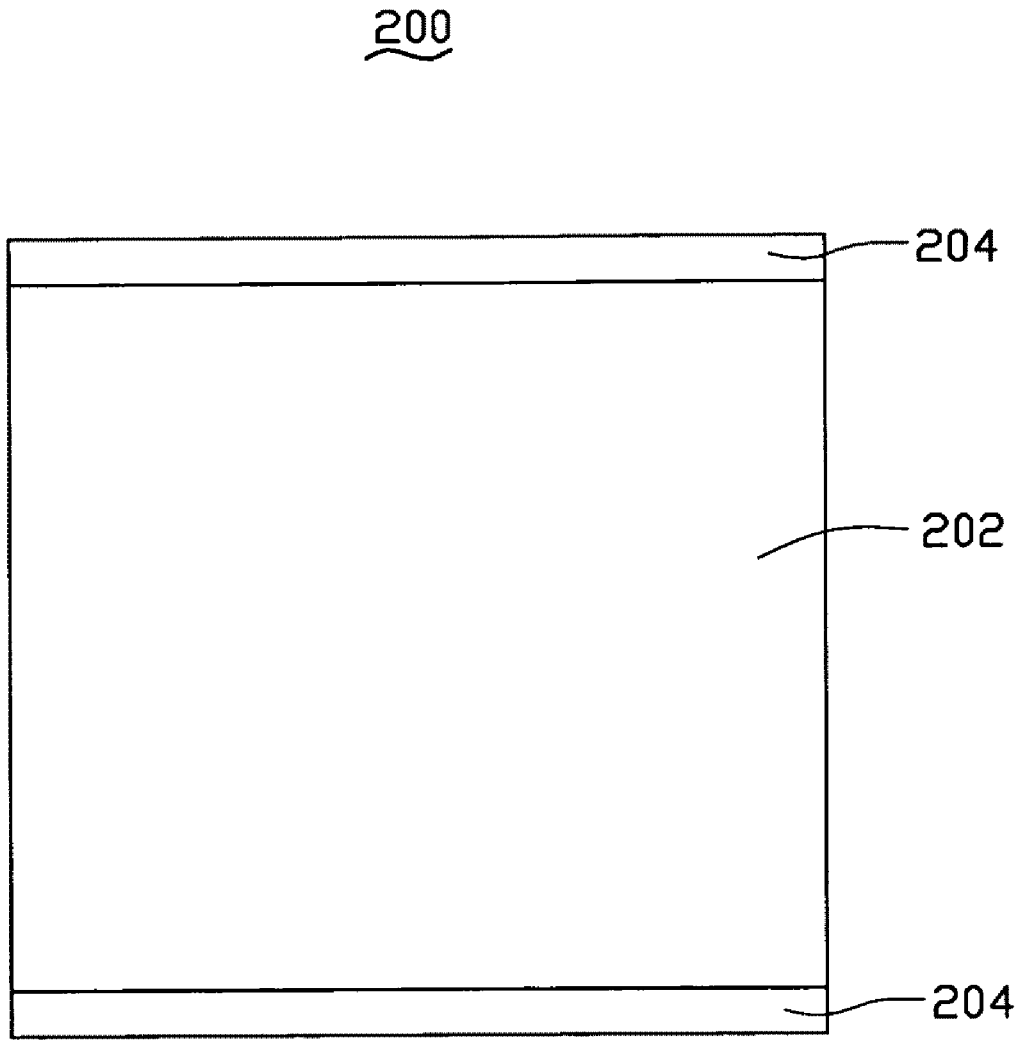
FIG. 10 is a schematic structural view of one kind of sound wave generator.

Referring to FIG. 10, the carbon nanotube structure 202 can be a square, and the length of the strip shaped electrodes 204 can be equal to or larger than the length of two opposite edges of the carbon nanotube structure 202. Thus, when the electrodes 204 are disposed along the opposite edges of the carbon nanotube structure 202, all the carbon nanotube structure 202 can be electrically conducted, that results a maximum use of the entire carbon nanotube structure 202. In this embodiment, the carbon nanotube structure 202 includes a drawn carbon nanotube film, and the carbon nanotubes in the carbon nanotube structure 202 are aligned along the direction from one electrode 204 to the other electrode 204. It is also noted, that if there is a tear in the carbon nanotube structure 202, sound can still be produced as long as there is some connection between the two electrodes 204.

Figure 11:
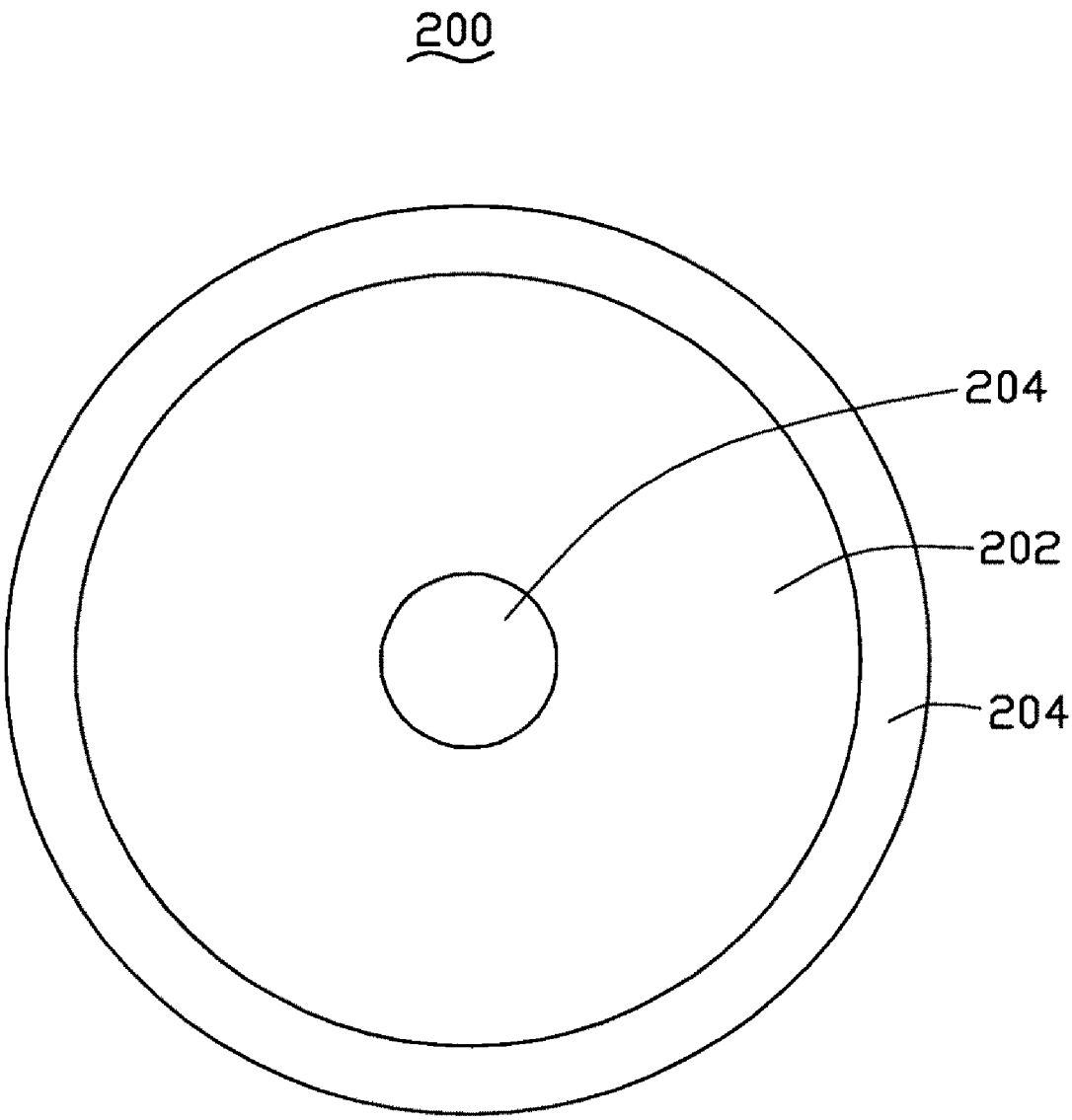
FIG. 11 is a schematic structural view of a circular sound wave generator.

Referring to FIG. 11, the carbon nanotube structure 202 can be a round. One electrode 204 can be disposed at the edge of the carbon nanotube structure 202, as while as another electrode 204 can be disposed at the center of the carbon nanotube structure 202. The carbon nanotube structure 202 can have carbon nanotubes that aligned radially from the center of the carbon nanotube structure 202. In one embodiment, a plurality of drawn carbon nanotube films or carbon nanotube wire structures can be radially arranged corresponding and to a round electrode 204 at a central point, wherein the drawn carbon nanotube films may have relatively narrow width.

The electrodes 204 are made of conductive material. The shape of the electrodes 204 is not limited and can be selected from a group consisting of lamellar, rod, wire, block and other shapes. A material of the electrodes 204 can be selected from a group consisting of metals, conductive adhesives, carbon nanotubes, and indium tin oxides. In one embodiment, the electrodes 204 are layer formed by silver paste.

In another embodiment, the electrodes 204 can be a metal rod and provide structural support for the carbon nanotube structure 202. Because, some of the carbon nanotube structures 202 have large specific surface area, some carbon nanotube structures 202 can be adhered directly to the electrodes 204. This will result in a good electrical contact between the carbon nanotube structures 202 and the electrodes 204. The two electrodes 204 can be electrically connected to two output ports of a signal input device by the wire 230.

In other embodiments, a conductive adhesive layer (not shown) can be further provided between the carbon nanotube structures 202 and the electrodes 204. The conductive adhesive layer can be used to provide electrical contact and more adhesion between the electrodes 204 and the carbon nanotube structures 202. In one embodiment, the conductive adhesive layer is a layer of silver paste.

In addition, it can be understood that the electrodes 204 are optional. The carbon nanotube structures 202 can be directly connected to the signal input device. Any means of electrically connecting the signal input device to the carbon nanotube structures 202 can be used.

The earphone 20 can further include a framing element 220. The framing element 220 is fixed inside the housing 210 or integrated with the housing 210. The sound wave generator 200 can be supported by the framing element 220, and spaced from the housing 210. A shape of the framing element 220 is not limited. In one embodiment, the framing element 220 can be a frame or two rods. The carbon nanotube structure 202 is supported by the frame or rods that suspend part of the carbon nanotube structure 202 in air. Thus, a good thermal exchange of the carbon nanotube structure 202 and the air can be achieved. In the embodiment shown in FIG. 1, the framing element 220 is integral of the housing 210. Further, the electrodes 204 has a relatively rigid shape, such as metal wires, which can also be used as the framing element 220.

Figure 12:
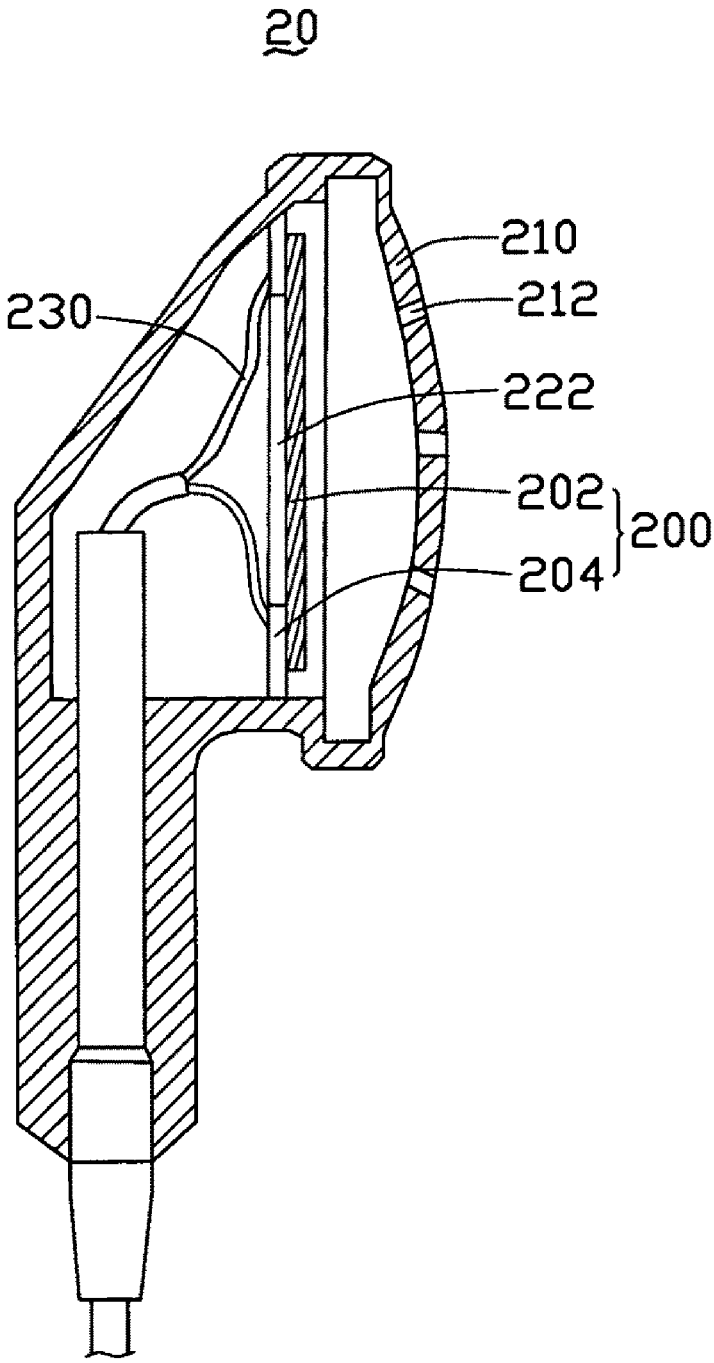
FIG. 12 is a schematic structural view of a headphone employing a supporting member.

In another embodiment, the earphone 20 can further include a supporting element 222. At least a part of the carbon nanotube structure 202 can be disposed on the supporting element 222. The supporting element 222 can have a planar and/or a curved surface. The supporting element 222 can also have a surface where the sound wave generator 200 can be securely located, exposed or hidden. Referring to FIG. 12, the entire carbon nanotube structure 202 can be located directly on and in contact with the surface of a supporting element 222.

The material of the supporting element 222 is not limited, and can be a rigid material, such as diamond, glass or quartz, or a flexible material, such as plastic, resin, fabric. The supporting element 222 can have a good thermal insulating property, thereby preventing the supporting element 222 from absorbing the heat generated by the carbon nanotube structure 202. The supporting element 222 can have a good electrical insulating property, thereby preventing a short circuit of the earphone 20. Further, the supporting element 222 can also be capable of reflecting heat generated by the sound wave generator 200. In addition, the supporting element 222 can have a relatively rough surface that contact with the carbon nanotube structure 202, thus the carbon nanotube structure 202 can have a greater contact area with the surrounding medium, and the acoustic performance of the earphone 20 can be improved to a certain extent.

It is to be understood that the supporting element 220 is optional. The carbon nanotube structure 202 can be directly disposed in the internal surface of the housing 210.

The wire 230 can transmit the electrical signals input from the signal input device to the sound wave generator 200. Energy of the electrical signals can be absorbed by the carbon nanotube structure 202 and the resulting energy will then be radiated as heat. This heating causes detectable sound signals due to pressure variation in the surrounding (environmental) medium such as air.

The carbon nanotube structure 202 includes a plurality of carbon nanotubes and has a small heat capacity per unit area and can have a large area for causing the pressure oscillation in the surrounding medium by the temperature waves generated by the sound wave generator 200. In use, when signals, e.g., electrical signals, with variations in the application of the signal and/or strength are input applied to the carbon nanotube structure 202 of the sound wave generator 200, heating and variations of heating are produced in the carbon nanotube structure 202 according to the signal. Variations in the signals (e.g. digital, change in signal strength), will create variations in the heating. Temperature waves are propagated into surrounding medium. The temperature waves in the medium cause pressure waves to occur, resulting in sound generation. In this process, it is the thermal expansion and contraction of the medium in the vicinity of the carbon nanotube structure 202 that produces sound. This is distinct from the mechanism of the conventional sound wave generator, in which the pressure waves are created by the mechanical movement of the diaphragm. The operating principle of the sound wave generator 200 is an "electrical-thermal-sound" conversion.

Figure 13:
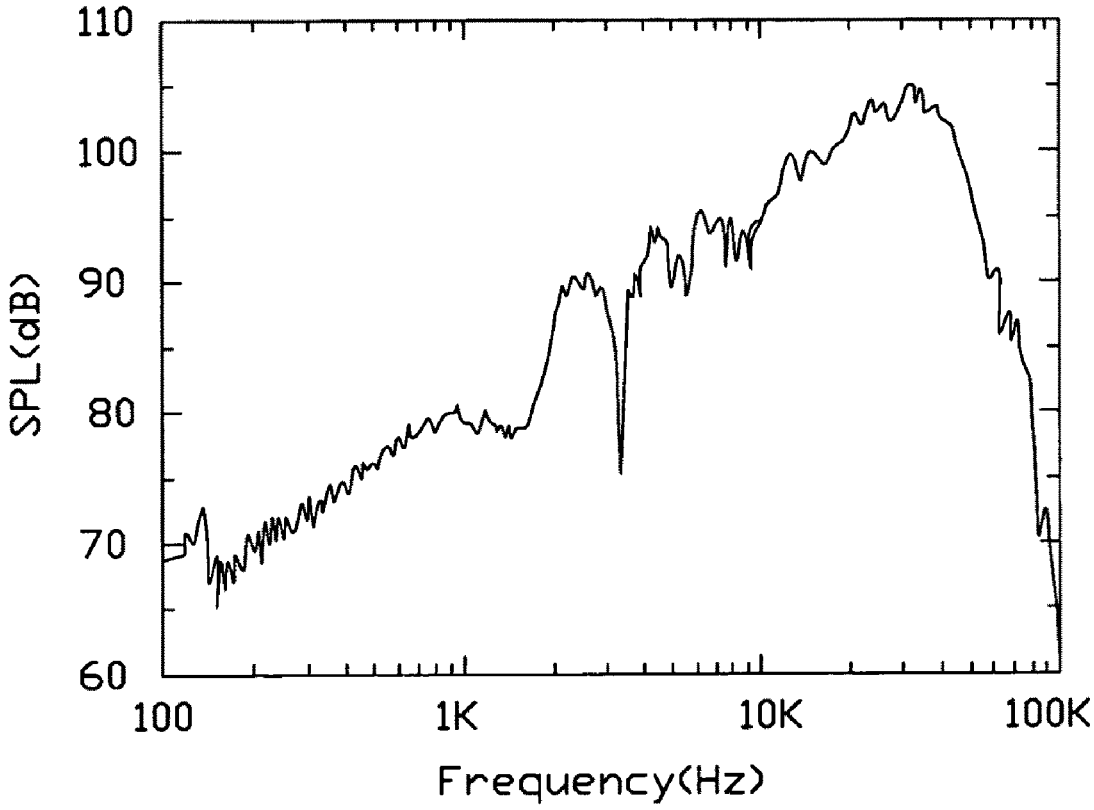
FIG. 13 is a frequency response curve of a sound wave generator according to one embodiment.

FIG. 13 shows a frequency response curve of the carbon nanotube structure 202 including a single carbon nanotube film, and having a length and width of 30 millimeters. The carbon nanotube film in this embodiment a drawn carbon nanotube film. To obtain these results, an alternating electrical signal with 50 voltages is applied to the carbon nanotube structure 202. A microphone was put in front of the carbon nanotube structure 202 at a distance of about 5 centimeters away from the carbon nanotube structure 202. As shown in FIG. 13, the carbon nanotube structure 202 has a wide frequency response range and a high sound pressure level. The sound pressure level of the sound waves generated by the carbon nanotube structure 202 can be greater than 50 dB at a distance of 5 cm between the carbon nanotube structure 202 and a microphone. The sound pressure level generated by the acoustic device 10 reaches up to 105 dB. The frequency response range of the carbon nanotube structure 202 can be from about 1 Hz to about 100 KHz with power input of 4.5 W. The total harmonic distortion of this carbon nanotube structure 202 is extremely small, e.g., less than 3% in a range from about 500 Hz to 40 KHz. In use of the headphone 20, the carbon nanotube structure 202 can be cut into small size, and the power of the input signals can be decreased by a control circuit, and thereby minimizing the sound to a suitable volume.

Further, since the carbon nanotube structure 202 has an excellent mechanical strength and toughness, the carbon nanotube structure 202 can be tailored to any desirable shape and size, allowing a headphone of most any desired shape and size to be achieved.

Figure 14:
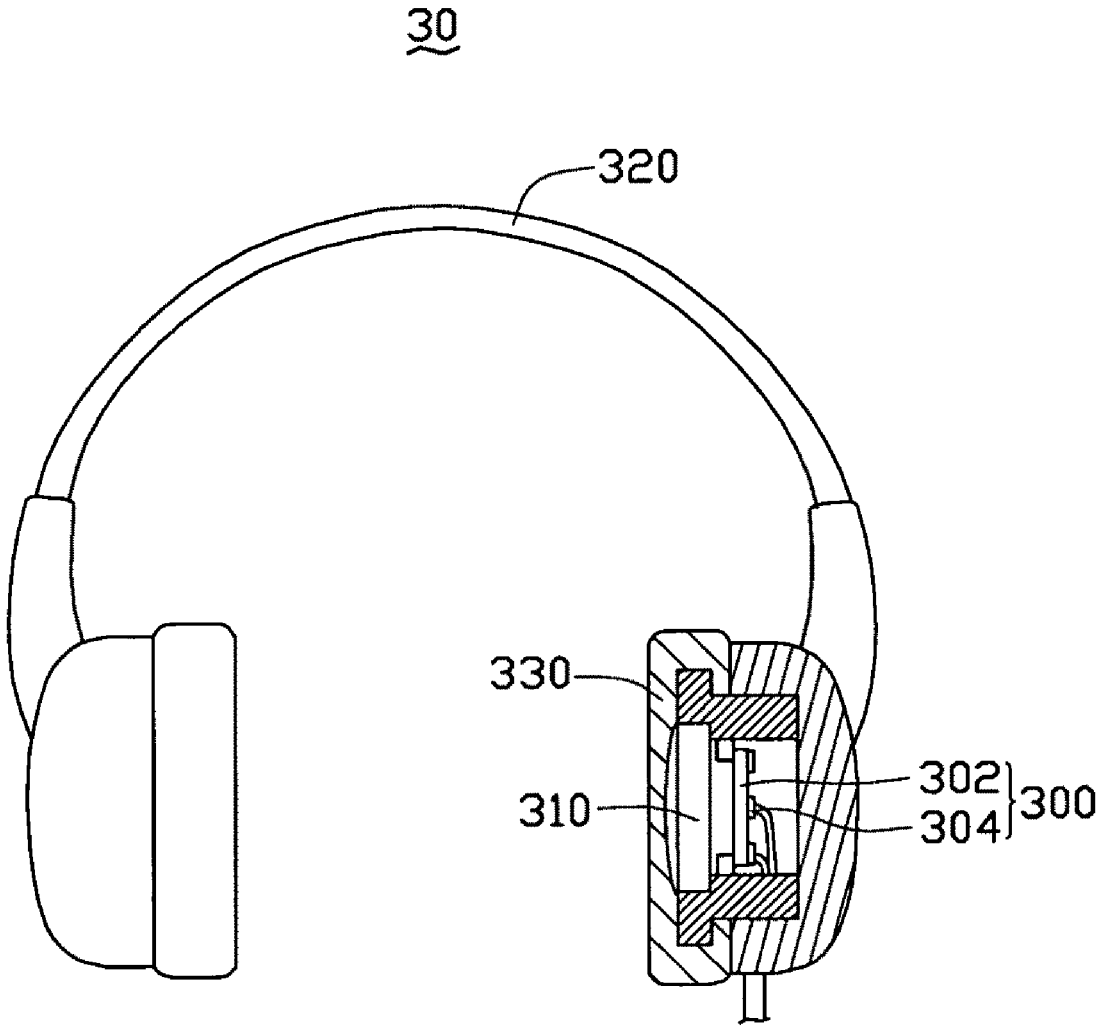
FIG. 14 is a schematic structural view of a headphone in accordance with another embodiment.

Referring to FIG. 14, an ear-cup type headphone 30 according another embodiment is shown. It includes two housings 310, a headband 320, and at least two sound wave generators 300. The headband 320 is a curved structure that capable of being mounted on the listener's head. The two ends of the headband 320 are connected to the two housings 310. When the headband 320 is worn on the listener's head, the housings 310 attached to both end portions of the headband 320 are slightly pressed to the corresponding ear by a piece such as a plate spring, etc. associated with the headband 320.

The inside structure of the housing 310 of the ear-cup type headphone 30 is similar to the inside structure of the housing 210. Each housing 310 encloses at least one sound wave generator 300. In one embodiment, two or more sound wave generators 300 are disposed inside a single housing 310. At least one sound wave generator 300 includes a carbon nanotube structure 302, whereas other sound wave generators can be electro-dynamic sound wave generators, electromagnetic sound wave generators, electrostatic sound wave generators, another carbon nanotube structure 302 or piezoelectric sound wave generators. The sound wave generator 300 can further include at least two electrodes 304 spaced from each other and connected to the carbon nanotube structure 302.

The different sound wave generators 300 can be separately connected to different wires 320 that input different electrical signals. The different sound wave generators 300 can cooperate with each other to achieve a good stereo effect.

The ear-cup type headphone 30 can further include two ear pads 330 covering the housing 310. The ear-cup type headphone 30 can also include a microphone (not shown) connected to the headband 320. The ear-cup type headphone 30 can also include wireless signal receiving elements (not shown) inside the housings 310 and electrically connected to the sound wave generators 300, thereby providing the sound wave generator 300 with wireless signals.

Figure 15:
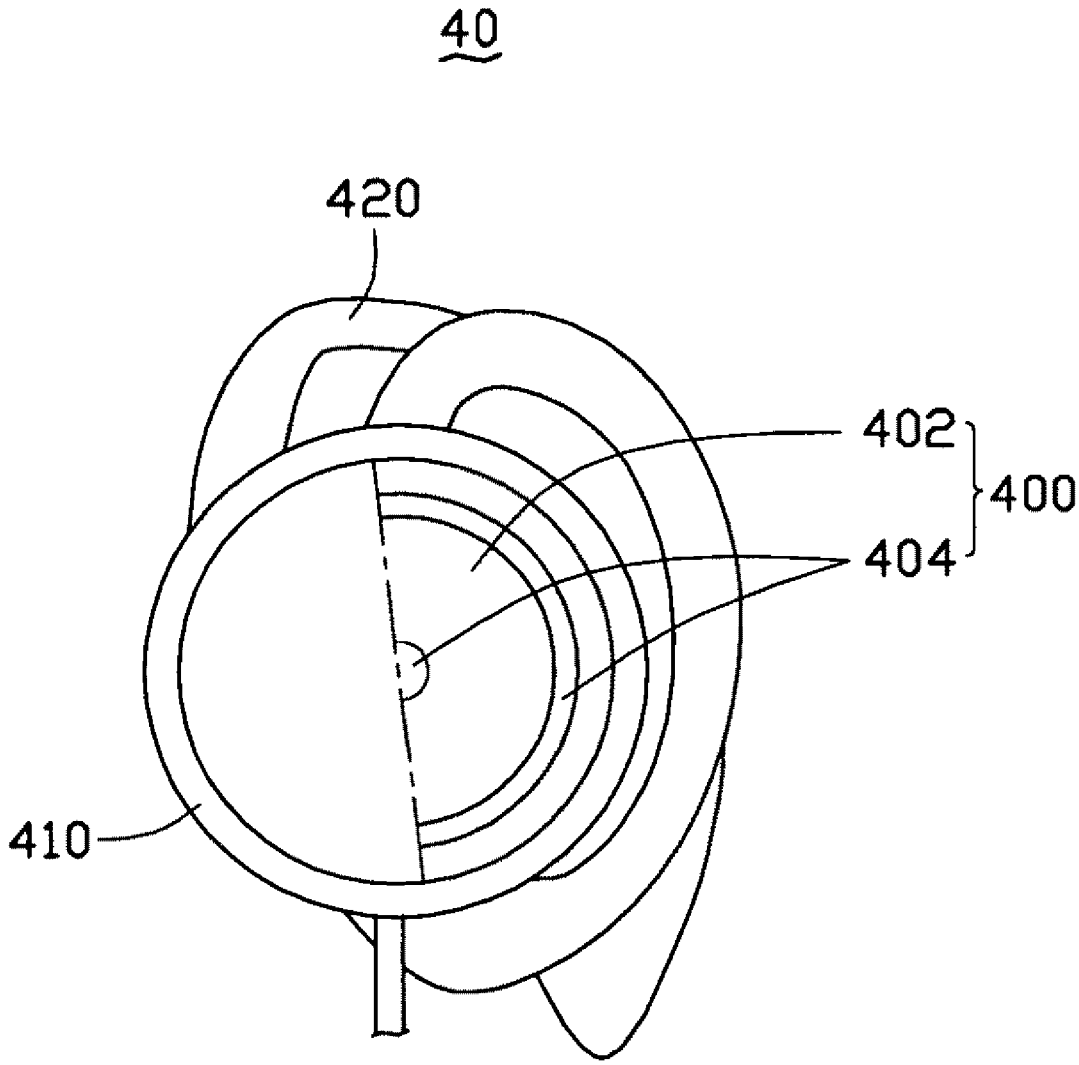
FIG. 15 is a schematic structural view of a headphone in accordance with yet another embodiment.
Figure 16:
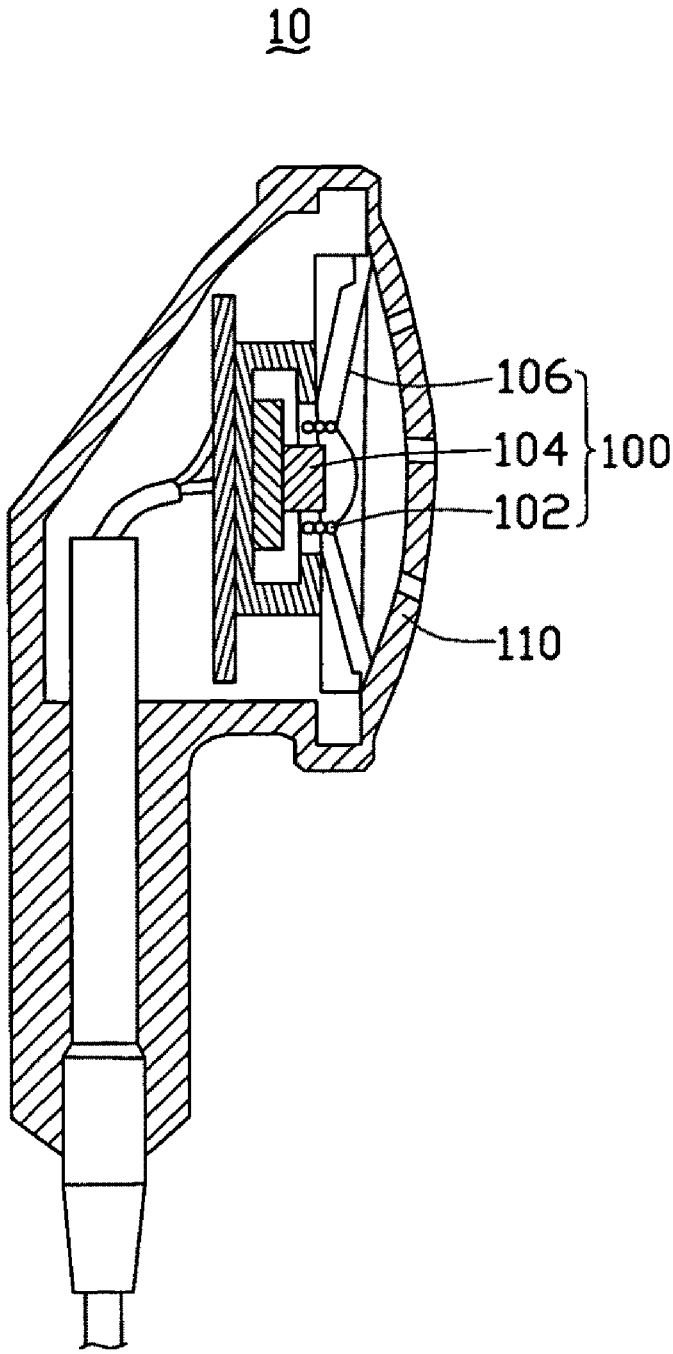
FIG. 16 (PRIOR ART)
FIG. 16 is a schematic structural view of a conventional headphone according to the prior art.

Referring to FIG. 15, an ear-hanging type headphone 40 according to a third embodiment includes a housing 410, an ear hanger arm 420 and at least one sound wave generator 400. The ear hanger arm 420 is connected to the housing 410, bent to a shape wrapped around the ear that capable of hanging on the listener's ear. The housing 410 connected to the ear hanger arm 420 is attached to the listener's ear.

The inside structure of the housing 410 of the ear-hanging type headphone 40 is similar to the inside structure of the housing 210. At least one sound wave generator 400 is disposed inside the housing 410. At least one sound wave generator 400 includes a carbon nanotube structure 402, whereas other sound wave generators can be an electro-dynamic sound wave generator, an electromagnetic sound wave generator, an electrostatic sound wave generator, another carbon nanotube structure 402 or a piezoelectric sound wave generator. The sound wave generator 400 can further include at least two electrodes 404 spaced from each other and connected to the carbon nanotube structure 402.

The different sound wave generators 400 can be separately connected to different wires 420 that input different electrical signals. The different sound wave generators 400 can cooperate with each other to achieve a good stereo effect.

The ear-hanging type headphone 40 can further include an ear pad (not shown) covering the housing 410. The ear-hanging type headphone 40 can also include a microphone (not shown) connected to the housing 410. The ear-hanging type headphone 40 can also include wireless signal receiving elements (not shown) inside the housings 410 and electrically connected to the sound wave generators 400, thereby providing the sound wave generator 400 with wireless signals.

It is to be understood the carbon nanotube structure can be used in any number of headphones to replace the speakers currently employed.

The sound wave generator 200, 300, 400 in the headphone 20, 30, 40 is able to only include the carbon nanotube structure, without any magnet or other complicated structure. The structure of the headphone 20, 30, 40 is simple and decreases the cost of production. The sound wave generator 200, 300, 400 adopts carbon nanotube structure to receive the input audio frequency electrical signal. The carbon nanotube structure transforms the electric energy to heat that causes surrounding air expansion and contraction according to the same frequency of the input signal and results a hearable sound pressure. Thus, the sound wave generator 200, 300, 400 in the headphone 20, 30, 40 can work without a vibration film and magnetic field. The carbon nanotube structure can provide a wide frequency response range (1 Hz to 100 kHz), and a high sound pressure level. The carbon nanotube structure can be cut into any desirable shape and size that meets different needs of different kinds of headphones 20, 30, 40. The carbon nanotube structure can be small in scale, and thus the size of the headphones 20, 30, 40 can be decreased. Further, the carbon nanotube structure has a light weight, and the headphones 20, 30, 40 adopts the carbon nanotube structure can work without many additional elements in the conventional headphones. Thus, the headphones 20, 30, 40 can be light weight.

Finally, it is to be understood that the above-described embodiments are intended to illustrate rather than limit the invention. Variations may be made to the embodiments without departing from the spirit of the invention as claimed. Elements associated with any of the above embodiments are envisioned to be associated with any other embodiments. The above-described embodiments illustrate the scope of the invention but do not restrict the scope of the invention.

What is claimed is:

1. An apparatus comprising:

a headphone, the headphone comprising:

at least one housing; and at least one sound wave generator disposed in the at least one housing, the at least one sound wave generator comprising at least one carbon nanotube structure, the at least one carbon nanotube structure is capable of producing sound by a thermoacoustic effect;

wherein the at least one carbon nanotube structure is capable of producing sound in response to an electrical signal, the electrical signal is capable of causing the at least one carbon nanotube structure to increase in temperature; the carbon nanotube structure is in contact with a medium and is capable of transmitting heat to the medium.

2. The apparatus of claim 1, wherein a heat capacity per unit area of the carbon nanotube structure is less than or equal to $2\times10^{-4}$ J/cm$^2$·K.

3. The apparatus of claim 1, wherein a frequency response range of the at least one sound wave generator ranges from about 1 Hz to about 100 KHz.

4. The apparatus of claim 1, wherein the carbon nanotube structure has a substantially planar structure, and a thickness of the carbon nanotube structure ranges from about 0.5 nanometers to about 1 millimeter.

5. The apparatus of claim 1, wherein the carbon nanotube structure comprises a plurality of carbon nanotubes, and the carbon nanotubes are combined by van der Waals attractive force therebetween.

6. The apparatus of claim 5, wherein the carbon nanotubes are arranged in a substantially systematic manner.

7. The apparatus of claim 5, wherein the carbon nanotubes are arranged along many different directions, such that the number of carbon nanotubes arranged along each different direction is almost the same.

8. The apparatus of claim 5, wherein the carbon nanotubes are aligned substantially along a same direction.

9. The apparatus of claim 5, wherein the carbon nanotubes are joined end to end by van der Waals attractive force therebetween.

10. The apparatus of claim 1, wherein the carbon nanotube structure comprises at least one carbon nanotube film, at least one carbon nanotube wire, or a combination of at least one carbon nanotube film and at least one carbon nanotube wire.

11. The apparatus of claim 1, further comprising at least two electrodes, the at least two electrodes are electrically connected to the carbon nanotube structure.

12. The apparatus of claim 11, wherein the carbon nanotube structure comprises a plurality of carbon nanotubes, the carbon nanotubes in the carbon nanotube structure are aligned along a direction from one electrode to the other electrode.

13. The apparatus of claim 1, wherein the at least one housing defines at least one through hole, the at least one sound wave generator is aligned with the at least one through hole.

14. The apparatus of claim 1, wherein the at least one housing comprises a supporting element, the at least one sound wave generator is supported by the supporting element.

15. The apparatus of claim 1 further comprising at least one wire connected to the at least one sound wave generator, wherein the at least one wire transmits electrical signals to the at least one sound wave generator.

16. The apparatus of claim 1 further comprising a wireless signal receiving element.

17. The apparatus of claim 1, wherein the headphone is an earphone, an ear-cup type headphone, or an ear-hanging type headphone.

18. The apparatus of claim 1, wherein the carbon nanotube structure produces heat in response to receiving a signal and heats a medium so that sound waves are created by the medium.

19. An apparatus comprising:

a headphone, the headphone comprising:

at least one housing; and at least one sound wave generator disposed in the at least one housing, the at least one sound wave generator comprising at least one carbon nanotube structure, wherein the at least one carbon nanotube structure is capable of producing sound by receiving an electrical signal and converting the electrical signal into heat to increase a temperature in a medium in contact with the carbon nanotube structure.

* * * * *